US005587700A

United States Patent [19]

Williams

[11] Patent Number: 5,587,700

[45] Date of Patent: Dec. 24, 1996

[54] PORTABLE SECURITY ALARM UNIT

[76] Inventor: Thomas Williams, R.R. #1, Box 110, West Danville, Vt. 05873

[21] Appl. No.: 297,374

[22] Filed: Aug. 29, 1994

[51] Int. Cl.[6] ..... G08B 13/00

[52] U.S. Cl. ..... 340/541; 340/567; 340/578; 340/693

[58] Field of Search ..... 340/541, 506, 340/565, 567, 546, 586, 600, 577, 578, 693, 825.31; 361/600

[56] References Cited

U.S. PATENT DOCUMENTS

| | | | |
|---|---|---|---|
| 5,019,802 | 5/1991 | Brittain et al. | 340/506 |
| 5,254,970 | 10/1993 | Brady | 340/693 |
| 5,337,043 | 8/1994 | Gokcebay | 340/825.31 |

*Primary Examiner*—John K. Peng

*Assistant Examiner*—Benjamin C. Lee

*Attorney, Agent, or Firm*—John J. Welch, Jr., Esq.

[57] ABSTRACT

The instant device is a portable security alarm unit. It is made up of a housing component containing control electronics, powered by an external power source, a back-up battery connected to the control electronics and wiring that connects the control electronics and/or battery to external accessories such as motion sensors, a siren, a temperature sensor and to a motion sensor and keyboard built into the frontally located walling of the housing component. There is also a slidable panel component that slides on tracks built into extensions of the roofing and flooring of the housing component such that the slidable panel component is capable of covering completely at any one time either the keyboard or motion sensor both of which are built in adjacent one another into the frontally located walling of the instant device's housing component.

24 Claims, 6 Drawing Sheets

PORTABLE SECURITY ALARM UNIT

FEDERALLY SPONSORED RESEARCH AND DEVELOPMENT

There is no federally sponsored research and development as respects the instant invention.

CROSS REFERENCES TO PRIOR APPLICATIONS

There are no prior or parent applications involving the instant invention.

BACKGROUND OF THE INVENTION

1. Field of the Invention

The instant invention relates to that collection of devices that serve to secure, via alarm systems, residential and commercial premises utilized for home or commercial purposes.

2. Possible Prior Art

The following references relate to possible prior art that however is distinctly different from the essence of the instant invention:

| Inventor | Invention | U.S. Pat. No. | Date |
|---|---|---|---|
| 1. Dolan et al | Automated Door Locking System for Aircraft Lavatory | 4,994,722 | 2/19/91 |
| 2. Humble, et al | Electrical Surveillance Apparatus with Moveable Antenna Elements | 4,394,645 | 7/19/93 |
| 3. Brown, et al | Modular Display Assembly | 3,736,035 | 5/29/73 |
| 4. Kowalski | Safety Door for Safes | 1,610,798 | 12/14/26 |
| 5. Koiso, et al | Cabinet with Foldable Sliding Doors | 4,279,454 | 7/21/81 |
| 6. Cavera | Burglar Alarm | 2,851,680 | 9/9/58 |

A SUMMARY OF THE INVENTION

A BRIEF DESCRIPTION OF THE INVENTION

The instant invention consists of inter alia a durable housing component within which there are housed some of the various components of a garden variety home or business security alarm system. Such items as are therein enclosed would be conventional control electronics, a back-up battery unit to be resorted to in the event of a power failure and wiring extending from such control electronics. Such wiring extends to accessories, to wit, one or more organic body heat detection sensors, an automated voice dialing unit, a temperature sensor, a unit serving to dial alarm messages automatically to pre-determined friendly phone numbers, a telephone jack and a keyboard. All of these accessories exist outside of the housing component except for one such body heat detection sensor unit and the keyboard both of which are built into a frontally located wall of the instant invention's housing component. The truly distinguishing feature of the invention is the slidable panel positioned on tracks in front of this frontally located wall. The slidable panel at any one time either covers the keyboard or the body heat detection sensor both of which lie side by side built into as noted above the frontally located walling of the instant invention's housing component.

OBJECT OF THE INVENTION

Conventional home security systems made up of all or most of the components mentioned above excepting the slidable panel positioned on tracks are relatively expensive to install in homes and buildings. And, they are expensive and often difficult to disassemble and remove from such homes or buildings when, for example, their owners are seeking to relocate. The instant invention, an intact complete security alarm system is extremely inexpensive to set up within a given home or building. And, due to its intactness and hence portability, it is likewise very inexpensive and indeed simple to disassemble together with its external accessory components and carry it away to any new relocation site. Also, whereas, many conventional systems are conspicuous to strangers who might be inclined to anticipate the presence of any one of a number of variants of such systems within a home or building, such conventional systems are thus relatively amenable to being readily bypassed prior to the setting off of an alarm. However, the instant invention; in particular, in view of its novel slidable panel feature which distinguishes it so greatly from any of the above-mentioned conventional variants is extremely inconspicuous to the extent that a stranger seeking to locate it would virtually always never have enough time to find it before that stranger's presence would serve to activate the system's alarm.

Hence, respectfully submitted, the instant invention's ready amenability to installation and disassembly, its portability and extreme inconspicuousness within a furnished room render it not only new and useful but unquestionably unique in its essence. In point of fact, it cannot reasonably be disputed that the instant invention is truly revolutionary within the ambit of the art of security alarm systems.

A DESCRIPTION OF THE DRAWINGS

Figure 3:
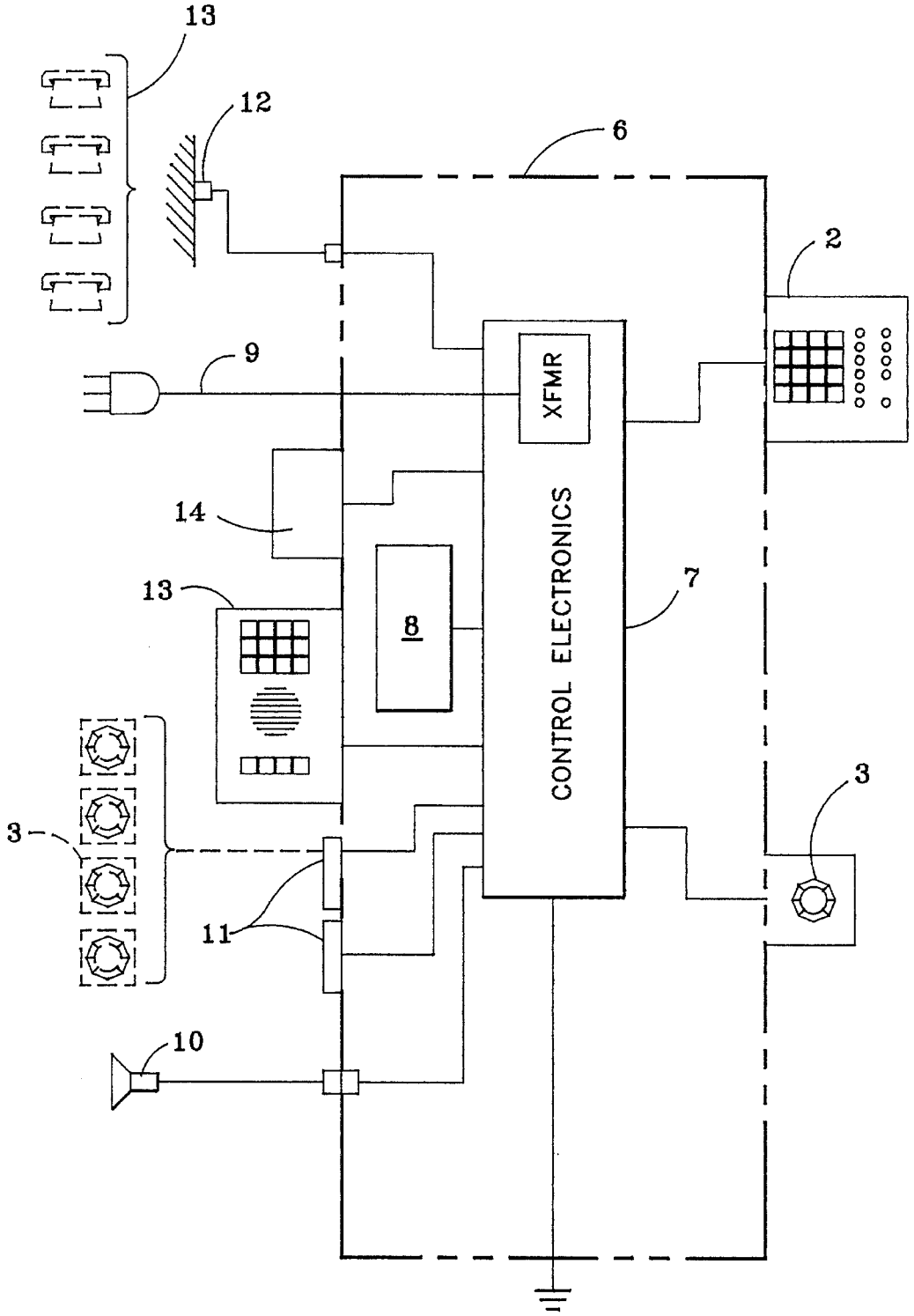

FIG. 3 serves to schematically depict the instant invention's internally housed control electronics and battery unit connected to its external accessories.

Figure 4:
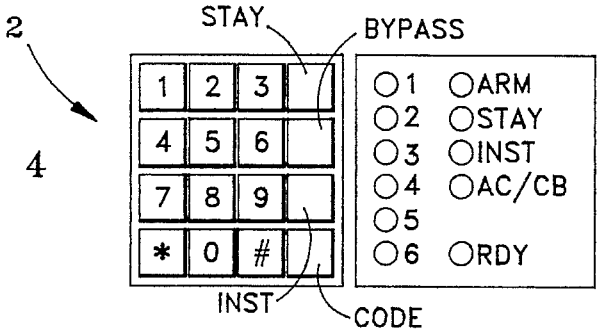

FIG. 4 illustrates an example of a keyboard that is built into the frontally located walling of the instant invention's housing component.

Figure 5:
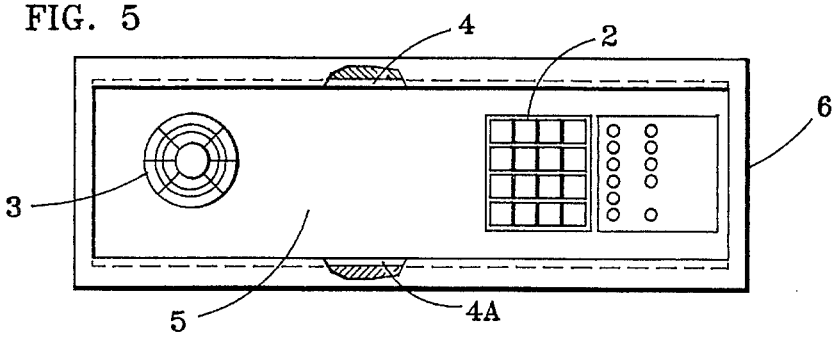

FIG. 5 shows the frontally located walling of the instant invention's housing component with built in keyboard and motion sensor. Also, therein shown in cutaway view are tracks for receipt of the invention's slidable panel component located anterior to the frontally located walling of the invention's housing component.

Figure 6:
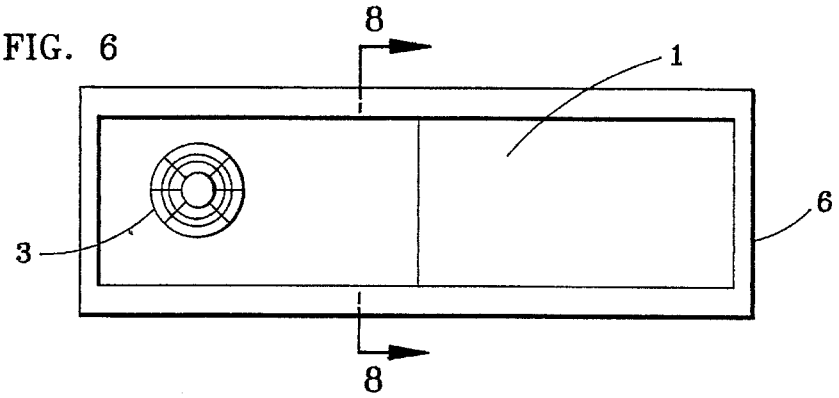

FIG. 6 shows the instant invention's slidable panel component covering the keyboard located on the frontally located walling of the invention's housing component.

Figure 7:
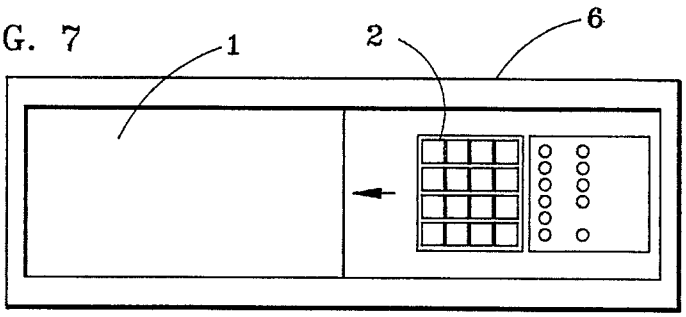

FIG. 7 shows the instant invention's slidable panel component covering the body heat detection sensor located on the frontally located walling of the invention's housing component.

Figure 8:
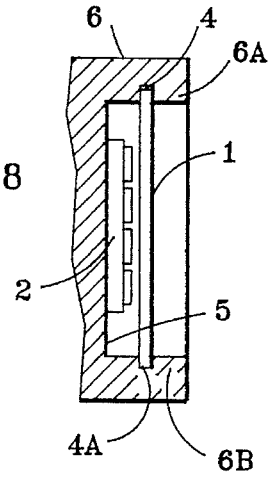

FIG. 8 illustrates in cross-sectional view, the instant invention's slidable panel component built into tracks located anterior to the keyboard found built into the frontally located walling o of the invention's housing component which tracks are built into frontally projected extensions of the roof and flooring of the invention's housing component.

Figure 9:
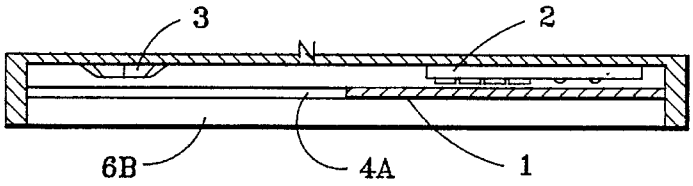

FIG. 9 is a top view of the frontal portion of the instant invention's housing component showing in cutaway view the positional relationship of its slidable panel component vis a vis the frontally located walling of its housing component here likewise shown covering its built in keyboard.

Figure 10:
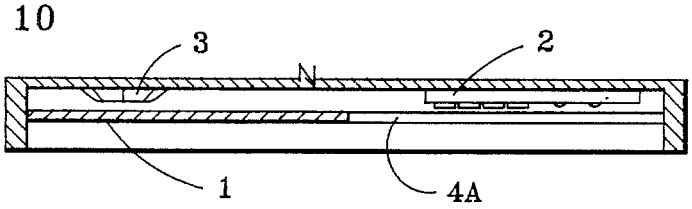

FIG. 10 is a top view of the frontal portion of the instant invention's housing component showing in cutaway view the positional relationship of its slidable panel component vis a vis the frontally located walling of its housing component here likewise shown covering its built in body heat detection sensor.

Figure 11:
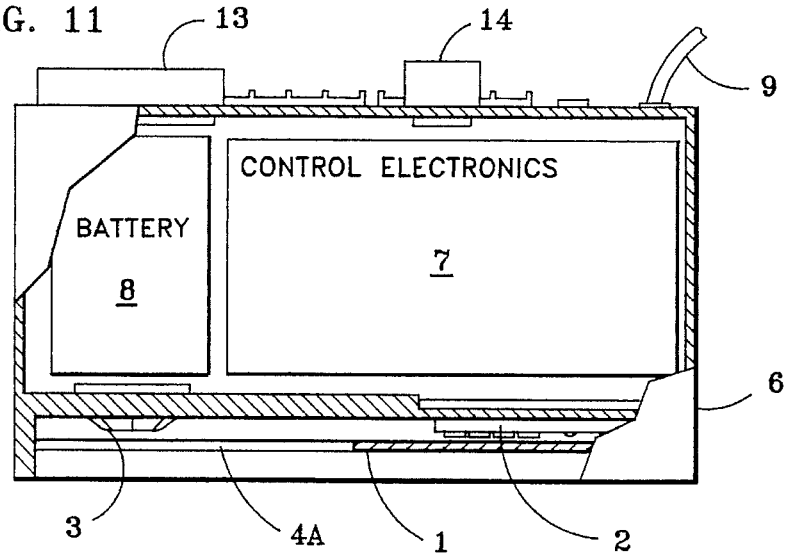

FIG. 11 is a cutaway top view of the instant invention's housing component showing its internally housed control electronics and battery.

Figure 12:
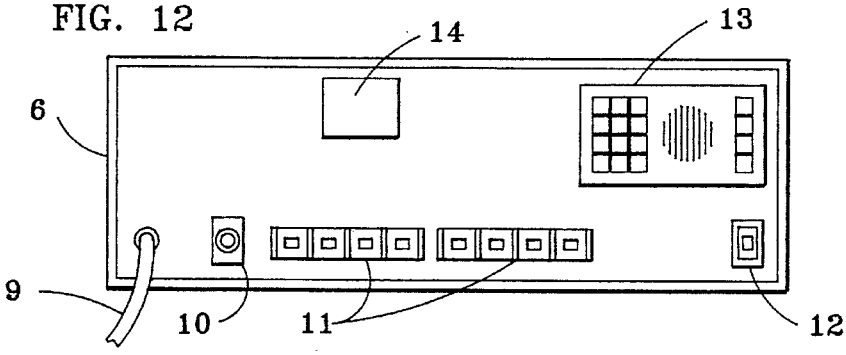

FIG. 12 is a rear view of the instant invention's housing component showing external accessories and contacts for attachment of wiring to further external accessories.

Figure 13:
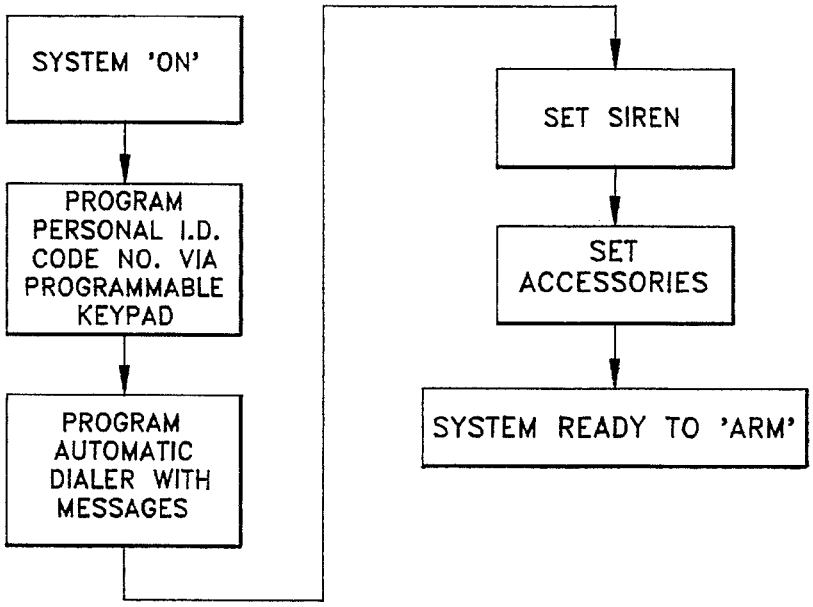

FIG. 13 is a flow chart depicting the various functions performable by the instant invention.

Figure 14:
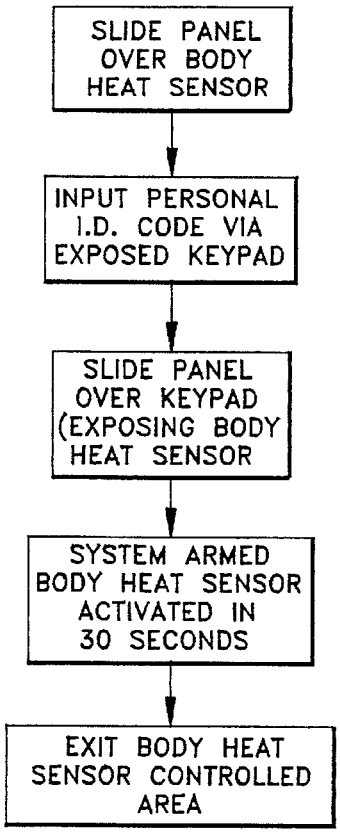

FIG. 14 is a flow chart depicting the system's arming protocol.

Figure 15:
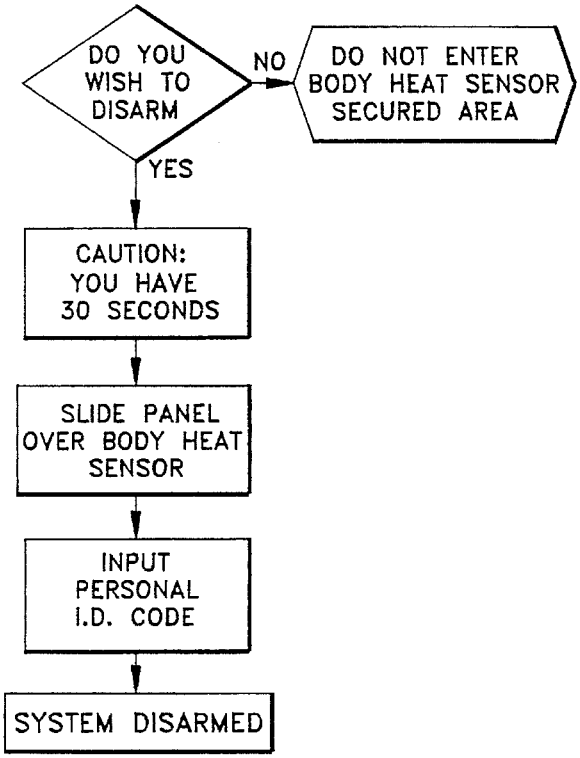

FIG. 15 is a flow chart depicting the steps to be taken by a person seeking to disarm the instant invention.

Figure 16:
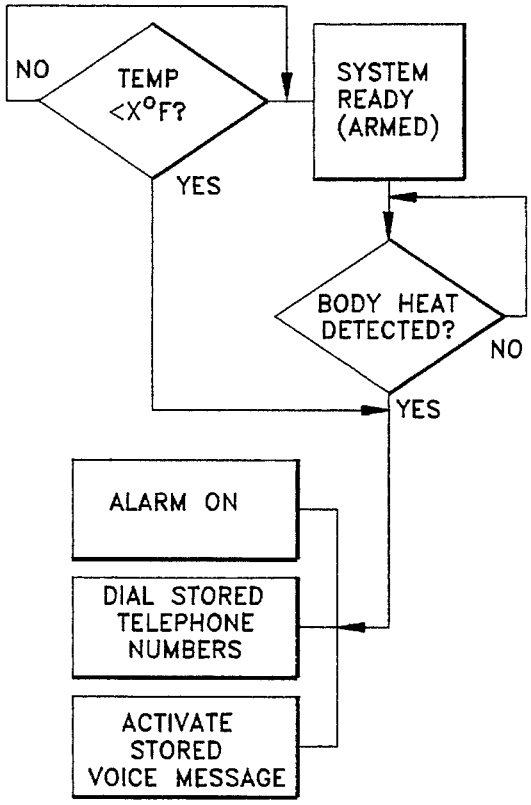

FIG. 16 is a flow chart depicting the various steps automatically followed by an armed machine.

Figure 17:
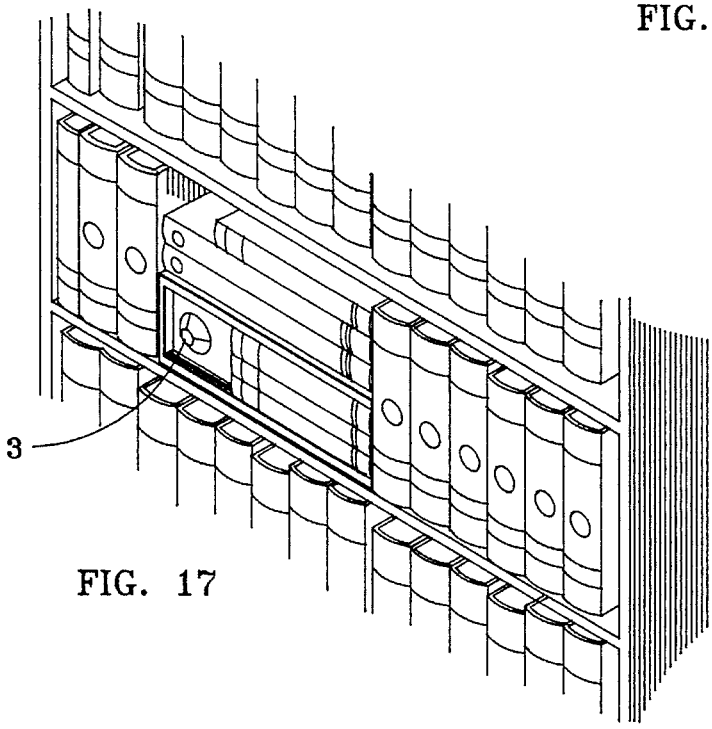

FIG. 17 is yet another view showing how the instant invention can be inconspicuously located in a room sought to be secured but showing a slidable panel component, the exterior side of which is fashioned so as to resemble books on a shelf.

A DESCRIPTION OF THE PREFERRED EMBODIMENT

Figure 1:
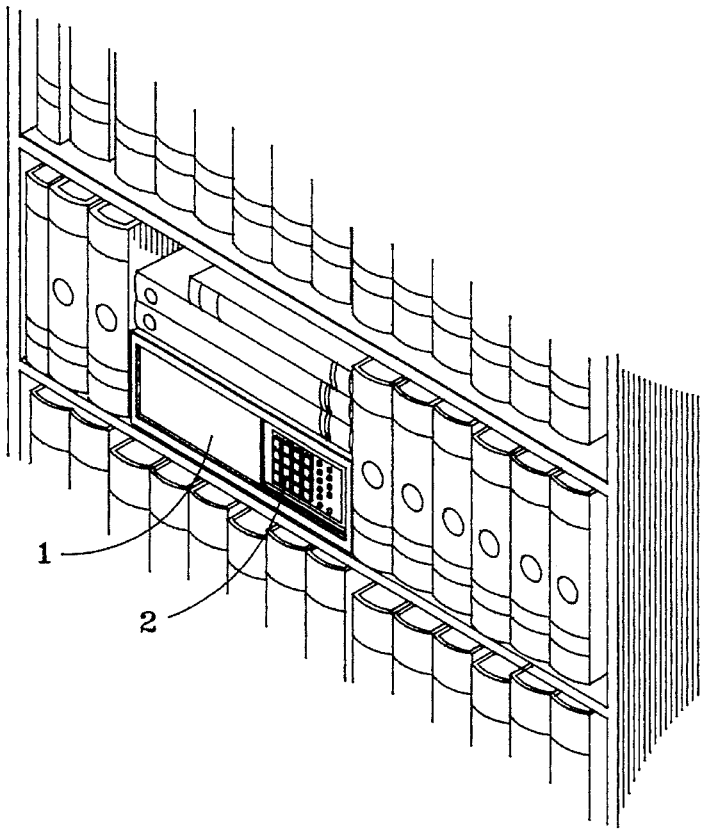
FIG. 1 shows the instant invention inconspicuously located on a bookshelf with its slidable panel component covering its built in motion sensor component.
Figure 2:
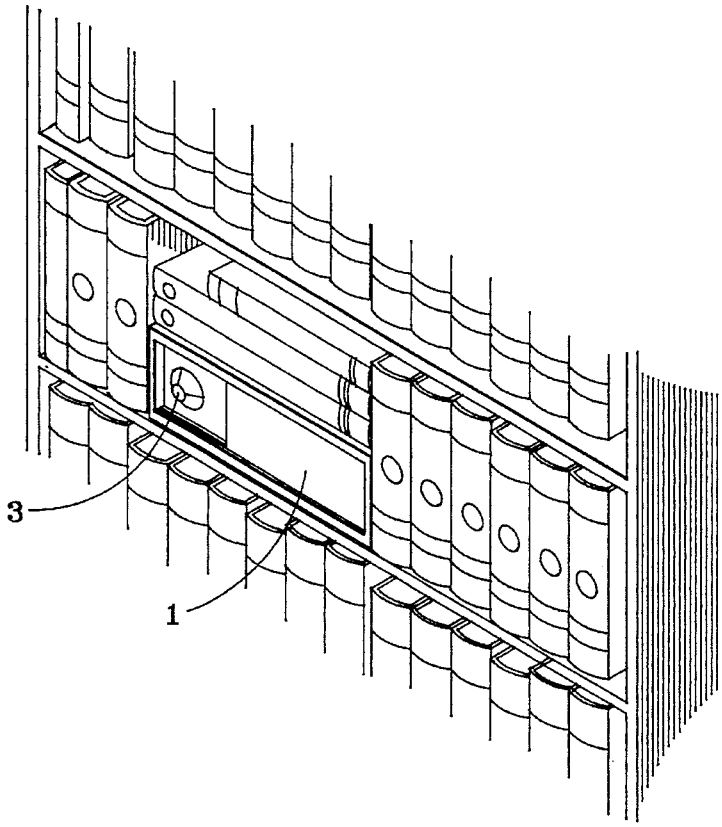
FIG. 2 shows the instant invention inconspicuously located on a bookshelf with its slidable panel component covering its built in keyboard component.

FIGS. 1 and 2 illustrates how the instant device can be placed inconspicuously within a bookcase in a room. FIG. 1 shows the device unarmed with its built in front wall body heat detection sensor component 3 covered by its slidable panel component 1. FIG. 2 shows the device armed with its front wall body heat detection sensor component 3 exposed and its built in front wall keyboard component 2 covered by its slidable panel component 1. The instant device's front wall keyboard component 2 is seen in isolated view in FIG. 4. FIG. 5 shows the frontally located walling 5 of the housing component 6 of the instant device with its built in front wall body heat detection sensor component unit 3 and its built in front wall keyboard component 2 absent the device's slidable panel component 1. FIG. 6 shows the frontally located walling 5 of the housing component 6 of the instant device, its built in front wall body heat detection sensor component 3 shown exposed and slidable panel component 1 covering built in keyboard component 2. FIG. 7 shows the frontally located walling 5 of housing component 6 of the instant device, built in front wall body heat detection sensor component 3 covered by slidable panel component 1 and built in keyboard component 2 shown exposed. FIG. 8, a cross-sectional view of a frontally extending portion of housing component 6 of the instant device shows how the device's slidable panel component 1 is slidable on tracks 4 and **4*a* in front of, for example, its built in keyboard component 2. Tracks 4 and 4*a* extend across the whole of the frontally extending portion 6A of the roofing and across the whole of the frontally extending portion 6B of the flooring of housing component 6 of the instant device as can be noted with reference to FIG. 5. FIGS. 9 and 10 are cross-sectional top views of the frontally extending portion 6A of the roofing of housing component 6 of the instant device that illustrates as well the slidability of slidable panel component 1 on tracks, here track 4, as also seen in FIG. 8, cut into the frontally extending portion 6A of the roofing of housing component 6 of the instant device in front of its frontally located walling 5 where keyboard component 2 and front wall body heat detection sensor component 3 are found located. FIG. 11 is a cutaway top view of the whole of the instant device evidencing as well what is seen FIGS. 9 and 10. FIG. 3 and FIGS. 11 and 12 evidence the control electronics 7 and battery 8 as well as accessories such as line cord 9, alarm 10, external contacts 11, telephone jack 12, voice dialer 13 and temperature sensor 14 of the instant device. Control electronics 7, battery 8, cord 9, alarm 10, contacts 11, jack 12, dialer 13 and sensor 14 are all component parts of alarm and security systems presently being sold to the public. However, the feature that markedly distinguishes the instant device from such other alarm and security systems is the feature of unique, compact portability such as is afforded by housing component 6 coupled with the capability afforded by slidable panel component 1 whereby the intact instant device, equipped with all or some of the features such as voice dialer 13, temperature sensor 14, and the like, is amenable to being conveniently and inconspicuously placed in a room sought to be secured. Just as important as respects the instant device's uniqueness is its ready amenability to being removed from that room sought to be secured and put quickly and conveniently into another room sought to be secured perhaps in a totally different building. Current state of the art systems are built into the walling of a home or office. Dismantling of such systems causes damage to the previously secured premises. Also, it is difficult to sell a dismantled system to someone. Both of these problems are obviated with respect to the instant device. Front wall body heat detection sensor component 3 detects the presence of heat emanating from the bodies of persons or animals found within the cone of influence of sensor component 3, inside a room where sensor component 3 is located, at a time when the instant device is in an armed mode. External contacts 11 enable the instant device to be connected to a plurality of door and window sensors that would react to the opening of a door or a window equipped with one while the instant device is in an armed mode. Contacts 11 could also be wired to other body heat detecting sensors as well. Cord 9 supplies external power to control electronics 7 in order to permit operation of the instant device. Battery 8 functions to permit continued operation of the instant device in the event of an external power failure. Alarm 10 emits a loud noise once a sensor is activated by either a person's body heat or the opening of a door or window equipped with an entry-exit sensor as the case may be and continues to emit such noise until the instant device is disarmed. Temperature sensor 14 responds to a change in temperature below a certain reading and via control electronics 7 is able just as is alarm 10 to trigger a signal via dialer 13 over phone jack 12 and phone lines to an outside agency in addition to itself being capable of activating alarm 10 as well. The outside agency once so notified would call the premises where the instant device is found and failing to obtain a reply or reply coupled with a pre-determined password that agency would then call local police or in the case of a sensor 14 signal, a plumber. FIG. 13 is a flow chart diagram serving to illustrate the overall capabilities of the instant device in a general way once the whole of the instant device is activatable. Typically, as with security devices currently in vogue, the device would be purchased with all accessories set. But, a keyboard and dialer can be reprogrammed from time to time to allow for the use of different keyboard access codes, usually a string of four numbers and different phone numbers of different persons to be called in the event an alarm is triggered. FIG. 14 is a flow chart diagram showing how the instant device is stepwise armed. The instant device permits a user to cover disarmed front wall body heat detection sensor component 3 with slidable panel component 1 and input his/her access code into keyboard component 2 thus arming the instant device. Slidable panel component 1 is then slid via tracks 4 and 4*a* so as to cover keyboard component 2 and expose now armed front wall body heat detecting sensor component 3. The user then exits the secured room and after a set number of seconds, for example, 30 seconds, sensor component 3 then becomes sensitive to the presence of heat emanating from humans or animals then found within the secured room. FIG. 15 is a flow chart diagram evidencing the protocol to be followed when it is sought to disarm the instant device. Sliding panel component i over front wall body heat detection sensor 3 exposes keyboard component 2 thus enabling one to within a given period of time, say, 30 seconds, input his/her personal code to thus disarm the instant device. Thus, as can be seen from the foregoing, the feature of slidability of slidable panel component 1 facilitates the ready arming and disarming of a compact, enclosed, portable security system. FIG. 16 is a flow chart diagram showing how sensor 14 will trigger dialer 13 or body heat will trigger alarm 10 and dialer 13** when the instant device is in an armed mode.

Other embodiments contemplate housing of various shapes; triangular, pentagonal, cylindrical and the like with frontal walling and slidable panels that are correspondingly fiat or curvaceous.

In closing, respectfully submitted, the instant device provides all of the desirable features of conventional home and office security systems currently in vogue, but, it is a marked improvement over all of those systems all of which are installed piece by piece into a home or office insomuch as the instant device is a totally self-contained pre-built, sturdy, portable system that is convenient to use and concomitantly easy to disassemble, remove and sell second-hand to others.

What is claimed is:

1. A portable security alarm unit comprising:

a. a rectangular shaped hollow housing component with a right lateral walling portion joined to a posterior walling portion, a left lateral walling portion joined to said posterior walling portion, said right lateral walling and said left lateral walling joined separately to a frontal walling portion, all of said walling portions joined to a roof and all of said walling portions joined to flooring;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programamble keyboard;

h. a body heat detection sensor having a sensor eye built into said frontal walling of said housing component positioned adjacent to the locus of said programmable keyboard;

i. wiring leading from said control electronics to said body heat detection sensor;

j. an alarm unit capable of generating noise connected by wiring to said control electronics which said wiring passes through a hole in any one of said walling portions, said flooring or said roof of said housing component;

k. a frontally projecting overhang with length equal to the length of said frontal walling portion which said frontally projecting overhang is an extension of said roof of said housing component;

l. a frontally projecting shelf with length equal to the length of said frontally projecting overhang which said frontally projecting shelf is an extension of said flooring of said housing component;

m. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

n. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

o. a positioning of said first notch and said second notch such that each said notch is in the same plane, to wit, a plane positioned parallel to the said plane containing the whole of said frontal walling portion;

p. a slidable panel insertable into said first notch and said second notch together with panel breadth less than the said breadth of said fwst notch and less than the said breadth of said second notch and panel height equal to approximately the vertical distance from the top side of said first notch to the bottom side of said second notch and panel length equal to at least the horizontal span of the eye of said body heat detection sensor.

2. A portable security alarm unit comprising:

a. a rectangular shaped hollow housing component with a right lateral walling portion joined to a posterior walling portion, a left lateral walling portion joined to said posterior walling portion, said right lateral walling and said left lateral walling joined separately to a frontal walling portion, all of said walling portions joined to a roof and all of said walling portions joined to flooring;

b. control electronics positioned within said housing component;

c. wiring leading from said control electronics through a hole in any one of said walling portions of said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. a plurality of external contacts affixed to one of said walling portions or said flooring or said roof of said housing component;

k. wiring leading from said control electronics to each of said external contacts;

l. an alarm unit capable of generating noise connectable by wiring to one of said external contacts;

m. wiring leading from one of said external contacts to said alarm unit;

n. a frontally projecting overhang with length equal to the length of said frontal walling portion which said frontally projecting overhang is an extension of said roof of said housing component;

o. a frontally projecting shelf with length equal to the length of said frontally projecting overhang which said frontally projecting shelf is an extension of said flooring of said housing component;

p. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

q. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

r. a positioning of said first notch and said second notch such that each said notch is in the same plane, to wit, a plane positioned parallel to the said plane containing the whole of said frontal walling portion;

s. a slidable panel insertable into said first notch and said second notch together with panel breadth less than the said breadth of said first notch and less than the said breadth of said second notch and panel height equal to approximately the vertical distance from the top side of said first notch to the bottom side of said second notch and panel length equal to at least the horizontal span of the eye of said body heat detection sensor.

3. A portable security alarm unit comprising:

a. a fully encased hollow housing component with a roof and flooring joined to a frontal walling portion, said roof and flooring joined to other walling portions and said other walling portions joined as well to said frontal walling portion;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. an alarm unit capable of generating noise connected by wiring to said control electronics which said wiring passes through a hole in any one of said walling portions, said flooring or said roof of said housing component;

k. a frontally projecting overhang with length equal to the length of said frontal walling portion which said frontally projecting overhang is an extension of said roof of said housing component;

l. a frontally projecting shelf with length equal to the length of said frontally projecting overhang which said frontally projecting shelf is an extension of said flooring of said housing component;

m. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

n. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

o. a positioning of said fwst notch and said second notch such that each said notch is in the same plane, to wit, a plane positioned parallel to the said plane containing the whole of said frontal walling portion;

p. a slidable panel insertable into said first notch and said second notch together with panel breadth less than the said breadth of said fwst notch and less than the said breadth of said second notch and panel height equal to approximately the vertical distance from the top side of said first notch to the bottom side of said second notch and panel length equal to at least the horizontal span of the eye of said body heat detection sensor.

4. A portable security alarm unit comprising:

a. a fully encased hollow housing component with a roof and flooring joined to a frontal walling portion, said roof and flooring joined to other walling portions and said other walling portions joined as well to said frontal walling portion;

b. control electronics positioned within said housing component;

c. wiring leading from said control electronics through a hole in any one of said walling portions of said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. a plurality of external contacts affixed to one of said walling portions or said flooring or said roof of said housing component;

k. wiring leading from said control electronics to each of said external contacts;

l. an alarm unit capable of generating noise connectable by wiring to one of said external contacts;

m. wiring leading from one of said external contacts to said alarm unit;

n. a frontally projecting overhang with length equal to the length of said frontal walling portion which said frontally projecting overhang is an extension of said roof of said housing component;

o. a frontally projecting shelf with length equal to the length of said frontally projecting overhang which said frontally projecting shelf is an extension of said flooring of said housing component;

p. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

q. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

r. a positioning of said first notch and said second notch such that each said notch is in the same plane, to wit, a plane positioned parallel to the said plane containing the whole of said frontal walling portion;

s. a slidable panel insertable into said first notch and said second notch together with panel breadth less than the said breadth of said first notch and said breadth less than the said breadth of said second notch and panel height equal to approximately the vertical distance from the top side of said first notch to the bottom side of said second notch and panel length equal to at least the horizontal span of the eye of said body heat detection sensor.

5. A portable security alarm unit comprising:

a. a rectangular shaped hollow housing component with a right lateral walling portion joined to a posterior walling portion, a left lateral walling portion joined to said posterior walling portion, said right lateral walling and said left lateral walling joined separately to a frontal waling portion, all of said walling portions joined to a roof and all of said walling portions joined to flooring;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. an alarm unit capable of generating noise connected by wiring to said control electronics which said wiring passes through a hole in any one of said walling portions, said flooring or said roof of said housing component;

k. a frontally projecting overhang with length equal to the length of said frontal walling portion which said frontally projecting overhang is an extension of said roof of said housing component;

l. a frontally projecting shelf with length equal to the length of said frontally projecting overhang which said frontally projecting shelf is an extension of said flooring of said housing component;

m. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

n. a second notch cut into said frontally projecting shelf with breadth less than the breadth of said frontally projecting shelf and running in a straight line parallel to the said positional lie of the said plane containing the whole of said frontal walling portion for a distance equal to the whole length of said frontally projecting shelf;

o. a positioning of said first notch and said second notch such that each said notch is in the same plane, to wit, a plane positioned parallel to the said plane containing the whole of said frontal walling portion;

p. a slidable panel insertable into said first notch and said second notch together with panel breadth less than the breadth of said first notch and less than the said breadth of said second notch and panel height equal to approximately the vertical distance from the top side of said first notch to the bottom side of said second notch and panel length equal to at least the horizontal span of the eye of said body heat detection sensor;

q. a temperature sensor connected by wiring to said control electronics through a hole in any one of said walling portions or said roof or said flooring of said housing component.

6. A portable security alarm unit comprising:

a. a rectangular shaped hollow housing component with a right lateral walling portion joined to a posterior walling portion, a left lateral walling portion joined to said posterior walling portion, said right lateral walling and said left lateral walling joined separately to a frontal walling portion, all of said walling portions joined to a roof and all of said walling portions joined to flooring;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. a plurality of external contacts affixed to one of said walling portions or said flooring or said roof or said housing component;

k. wiring leading from said control electronics to each of said external contacts;

l. an alarm unit capable of generating noise connectable by wiring to one of said external contacts;

m. wiring leading from one of said external contacts to said alarm unit;

n. a frontally projecting overhang with length equal to the length of said frontal walling portion which said frontally projecting overhang is an extension of said roof of said housing component;

o. a frontally projecting shelf with length equal to the length of said frontally projecting overhang which said frontally projecting shelf is an extension of said flooring of said housing component;

p. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

q. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

r. a positioning of said first notch and said second notch such that each said notch is in the same plane, to wit, a plane positioned parallel to said plane containing the whole of said frontal walling portion;

s. a slidable panel insertable into said fwst notch and said second notch together with panel breadth less than the said breadth of said fwst notch and less than the said breadth of said second notch and panel height equal to approximately the vertical distance from the top side of said first notch to the bottom side of said second notch and panel length equal to at least the horizontal span of the eye of said body heat detection sensor;

t. a temperature sensor connected by wiring to one of said external contacts.

7. A portable security alarm unit comprising:

a. a fully encased hollow housing component with a roof and flooring joined to a frontal walling portion, said roof and flooring joined to other walling portions and said other walling portions joined as well to said frontal walling portion;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. an alarm unit capable of generating noise connected by wiring to said control electronics which said wiring passes through a hole in any one of said walling portions, said flooring or said roof of said housing component;

k. a frontally projecting overhang with length equal to the length to said frontal walling portion which said frontally projecting overhang is an extension of said roof of said housing component;

l. a frontally projecting shelf with length equal to the length of said frontally projecting overhang which said frontally projecting shelf is an extension of said flooring of said housing component;

m. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

n. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

o. a positioning of said first notch and said second notch such that each said notch is in the same plane, to wit, a plane positioned parallel to the said plane containing the whole of said frontal walling portion;

p. a slidable panel insertable into said first notch and said second notch together with panel breadth less than the said breadth of said first notch and less than the said breadth of said second notch and panel height equal to approximately the vertical distance from the top side of said first notch to the bottom side of said second notch and panel length equal to at least the horizontal span of the eye of said body heat detection sensor;

q. a temperature sensor connected by wiring to said control electronics through a hole in any one of said walling portions or said roof or said flooring of said housing component.

8. A portable security alarm unit comprising:

a. a fully encased hollow housing component with a roof and flooring joined to a frontal walling portion, said roof and flooring joined to other walling portions and said other walling portions joined as well to said frontal walling portion;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. a plurality of external contacts affixed to one of said walling portions or said flooring or said roof of said housing component;

k. wiring leading from said control electronics to each of said external contacts;

l. an alarm unit capable of generating noise connectable by wiring to one of said external contacts;

m. wiring leading from one of said external contacts to said alarm unit;

n. a frontally projecting overhang with length equal to the length of said frontal walling portion which said frontally projecting overhang is an extension of said roof of said housing component;

o. a frontally projecting shelf with length equal to the length of said frontally projecting overhang which said frontally projecting shelf is an extension of said flooring of said housing component;

p. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

q. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

r. a positioning of said first notch and said second notch such that each said notch is in the same plane, to wit, a plane positioned parallel to the said plane containing the whole of said frontal walling portion;

s. a slidable panel insertable into said fwst notch and said second notch together with panel breadth less than the said breadth of said fwst notch and less than the said breadth of said second notch and panel height equal to approximately the vertical distance from the top side of said first notch to the bottom side of said second notch and panel length equal to at least the horizontal span of the eye of said body heat detection sensor;

t. a temperature sensor connected by wiring to said external contacts.

9. A portable security alarm unit comprising:

a. a rectangular shaped hollow housing component with a right lateral walling portion joined to a posterior walling portion, a left lateral walling portion joined to said posterior walling portion, said right lateral walling and said left lateral walling joined separately to a frontal walling portion, all of said walling portions joined to a roof and all of said walling portions joined to flooring;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. an alarm unit capable of generating noise connected by wiring to said control electronics which said wiring passes through a hole in any one of said walling portions, said flooring or said roof of said housing component;

k. a frontally projecting overhang with length equal to the length of said frontal walling portion which said frontally projecting overhang is an extension of said roof of said housing component;

l. a frontally projecting shelf with length equal to the length of said frontally projecting overhang which said frontally projecting shelf is an extension of said flooring of said housing component;

m. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

n. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

o. a positioning of said first notch and said second notch such that each said notch is in the same plane, to wit, a plane positioned parallel to the said plane containing the whole of said frontal walling portion;

p. a slidable panel insertable into said first notch and said second notch together with panel breadth less than the breadth of said first notch and less than the said breadth of said second notch and panel height equal to approximately the vertical distance from the top side of said first notch to the bottom side of said second notch and panel length equal to at least the horizontal span;

q. a temperature sensor connected by wiring to said control electronics through a hole in any one of said walling portions or said roof or said flooring of said housing component;

r. an automatic voice dialer unit connected by wiring to said control electronics through a hole in any one of said walling portions or said roof or said flooring of said housing component.

10. A portable security alarm unit comprising:

a. a rectangular shaped hollow housing component with a right lateral walling portion joined to a posterior walling portion, a left lateral walling portion joined to said posterior walling portion, said right lateral walling and said left lateral walling joined separately to a frontal walling portion, all of said walling portions joined to a roof and all of said walling portions joined to flooring;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. a plurality of external contacts affixed to one of said walling portions or said flooring or said roof or said housing component;

k. wiring leading from said control electronics to each of said external contacts;

l. an alarm unit capable of generating noise connectable by wiring to one of said external contacts;

m. wiring leading from one of said external contacts to said alarm unit;

n. a frontally projecting overhang with length equal to the length of said frontal walling portion which said frontally projecting overhang is an extension of said roof of said housing component;

o. a frontally projecting shelf with length equal to the length of said frontally projecting overhang which said frontally projecting shelf is an extension of said flooring of said housing component;

p. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

q. a second notch cut into said frontally projecting shelf with breadth less than the breadth of said frontally extending shelf and running in a straight line parallel to the said positional lie of the said plane containing the whole of said frontal walling portion for a distance equal to the whole of the length of said frontally projecting shelf;

r. a positioning of said first notch and said second notch such that each said notch is in the same plane, to wit, a plane positioned parallel to said plane containing the whole of said frontal walling portion;

s. a slidable panel insertable into said first notch and said second notch together with panel breadth less than the said breadth of said first notch and less than the said breadth of said second notch and panel height equal to approximately the vertical distance from the top side of said first notch to the bottom side of said second notch and panel length equal to at least the horizontal span of the eye of said body heat detection sensor;

t. a temperature sensor connected by wiring to one of said external contacts;

u. an automatic voice dialer connected by wiring to one of said external contacts.

11. A portable security alarm unit comprising:

a. a fully encased hollow housing component with a roof and flooring joined to a frontal walling portion, said roof and flooring joined to other walling portions and said other walling portions joined as well to said frontal walling portion;

b. control electronics positioned within said housing component;

c. wiring leading from said control electronics through a hole in any one of said wlling portions or said roof or said flooring of said housing component to an outside power source;

d. a battery positioned within said housing component;

c. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. an alarm unit capable of generating noise connected by wiring to said control electronics which said wiring passes through a hole in any one of said walling portions, said flooring or said roof of said housing component;

k. a frontally projecting overhang with length equal to the length to said frontal walling portion which said frontally projecting overhang is an extension of said roof of said housing component;

l. a frontally projecting shelf with length equal to the length of said frontally projecting overhang which said frontally projecting shelf is an extension of said flooring of said housing component;

m. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

n. a second notch cut into said frontally projecting shelf with breadth less than the breadth of said frontally projecting shelf and running in a straight line parallel to the said positional lie of the said plane containing the whole of said frontal walling portion for a distance equal to the whole of the length of said frontally projecting shelf;

o. a positioning of said first notch and said second notch such that each said notch is in the same plane, to wit, a plane positioned parallel to the said plane containing the whole of said frontal walling portion;

p. a slidable panel insertable into said first notch and said second notch together with panel breadth less than the said breadth of said first notch and less than the said breadth of said second notch and panel height equal to approximately the vertical distance from the top side of said first notch to the bottom side of said second notch and panel length equal to at least the horizontal span of the eye of said body heat detection sensor;

q. a temperature sensor connected by wiring to said control electronics through a hole in any one of said walling portions or said roof or said flooring of said housing component;

r. an automatic voice dialer unit connected by wiring to said control electronics through a hole in any one of said walling portions or said roof or said flooring of said housing component.

12. A portable security alarm unit comprising:

a. a fully encased hollow housing component with a roof and flooring joined to a frontal walling portion, said roof and flooring joined to other walling portions and said other walling portions joined as well to said frontal walling portion;

b. control electronics positioned within said housing component;

c. wiring leading from said control electronics through a hole in any one of said walling portions or said roof or said flooring of said housing component to an outside power source;

d. a battery positioned within said housing component;

e. wiring leading from said control electronics to said battery;

f. a programmable keyboard built into said frontal walling portion of said housing component;

g. wiring leading from said control electronics to said programmable keyboard;

h. a body heat detection sensor having a sensor eye built into said frontal walling of said housing component positioned adjacent to the locus of said programmable keyboard;

i. wiring leading from said control electronics to said body heat detection sensor;

j. a plurality of external contacts affixed to one of said walling portions or said flooring or said roof of said housing component;

k. wiring leading from said control electronics to each of said external contacts;

l. an alarm unit capable of generating noise connected by wiring to one of said external contacts;

m. wiring leading from one of said external contacts to said alarm unit;

n. a frontally projecting overhang with length equal to the length of said frontal walling portion which said frontally projecting overhang is an extension of said roof of said housing component;

o. a frontally projecting shelf with length equal to the length of said frontally projecting overhang which said frontally projecting shelf is an extension of said flooring of said housing component;

p. a first notch cut into said frontally projecting overhang with breadth less than the breadth of said frontally projecting overhang and running in a straight line parallel to the positional lie of the plane containing the whole of said frontal walling portion for a distance equal to the whole of the length of said frontally projecting overhang;

q. a second notch cut into said frontally projecting shelf with breadth less than the breadth of said frontally extending shelf and running in a straight line parallel to the said positional lie of the said plane containing the whole of said frontal walling portion for a distance equal to the whole of the length of said frontally projecting shelf;

r. a positioning of said first notch and said second notch such that each said notch is in the same plane, to wit, a plane positioned parallel to the said plane containing the whole of said frontal walling portion;

s. a slidable panel insertable into said first notch and said second notch together with panel breadth less than the said breadth of said first notch and less than the said breadth of said second notch and panel height equal to approximately the vertical distance from the top side of said first notch to the bottom side of said second notch and panel length equal to at least the horizontal span of the eye of said body heat detection sensor;

t. a temperature sensor connected by wiring to said external contacts;

u. an automatic voice dialer connected by wiring to one of said external contacts.

13. The portable security alarm unit of claim 1 whereby a telephone line connected to an external telephone jack is connected by wiring to said control electronics through a hole in any one of said walling portions or said roof or said flooring of said housing component.

14. The portable security alarm unit of claim 2 whereby a telephone line connected to an external telephone jack is connected to one of said external contacts.

15. The portable security alarm unit of claim 3 whereby a telephone line connected to an external telephone jack is connected by wiring to said control electronics through a hole in any one of said walling portions or said roof or said flooring of said housing component.

16. The portable security alarm unit of claim 4 whereby a telephone line connected to an external telephone jack is connected to one of said external contacts.

17. The portable security alarm unit of claim 5 whereby a telephone line connected to an external telephone jack is connected by wiring to said control electronics through a hole in any one of said walling portions or said roof or said flooring of said housing component.

18. The portable security alarm unit of claim 6 whereby a telephone line connected to an external telephone jack is connected to one of said external contacts.

19. The portable security alarm unit of claim 7 whereby a telephone line connected to an external telephone jack is connected by wiring to said control electronics through a hole in any one of said walling portions or said roof or said flooring of said housing component.

20. The portable security alarm unit of claim 8 whereby a telephone line connected to an external telephone jack is connected to one of said external contacts.

21. The portable security alarm unit of claim 9 whereby a telephone line connected to an external telephone jack is connected by wiring to said control electronics through a hole in any one of said walling portions or said roof or said flooring of said housing component.

22. The portable security alarm unit of claim 10 whereby a telephone line connected to an external telephone jack is connected to one of said external contacts.

23. The portable security alarm unit of claim 11 whereby a telephone line connected to an external telephone jack is connected by wiring to said control electronics through a hole in any one of said walling portions or said roof or said flooring of said housing component.

24. The portable security alarm unit of claim 12 whereby a telephone line connected to an external telephone jack is connected to one of said external contacts.

* * * * *